United States Patent [19]

House

[11] 4,308,949

[45] Jan. 5, 1982

[54] DISPENSING CARTON FOR SMALL BOTTLES

[75] Inventor: Richard F. House, St. Charles, Ill.

[73] Assignee: Container Corporation of America, Chicago, Ill.

[21] Appl. No.: 194,076

[22] Filed: Oct. 6, 1980

[51] Int. Cl.[3] ..... B65D 75/00

[52] U.S. Cl. ..... 206/148; 206/149; 206/528; 229/89

[58] Field of Search ..... 206/148, 149, 151, 152, 206/427, 434, 528; 229/89

[56] References Cited

U.S. PATENT DOCUMENTS

| | | | |
|---|---|---|---|
| 3,503,498 | 3/1970 | Lawrence | 206/152 |
| 3,834,750 | 8/1974 | Gauntlett | 206/148 |
| 3,968,914 | 7/1976 | Goncalves | 206/149 |
| 4,234,081 | 11/1980 | Champlin | 206/152 |

*Primary Examiner*—Joseph Man-Fu Moy

*Attorney, Agent, or Firm*—R. W. Carpenter; Davis Chin

[57] ABSTRACT

A one-piece folding carton having a well for receiving a plurality of plastic bottles and a pair of inner side wall panels with flaps having notches for receiving necks of the bottles.

4 Claims, 6 Drawing Figures

DISPENSING CARTON FOR SMALL BOTTLES

SUMMARY OF THE INVENTION

This invention relates to folding cartons for holding, displaying, and dispensing articles such as small plastic bottles arranged in one or two rows within the carton.

It is an object of the invention to provide a one-piece carton having hollow end walls defining a well for receiving packaged articles such as bottles, and having inner side walls with retaining flaps which engage the tops of the bottles and permit them to be removed one at a time.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
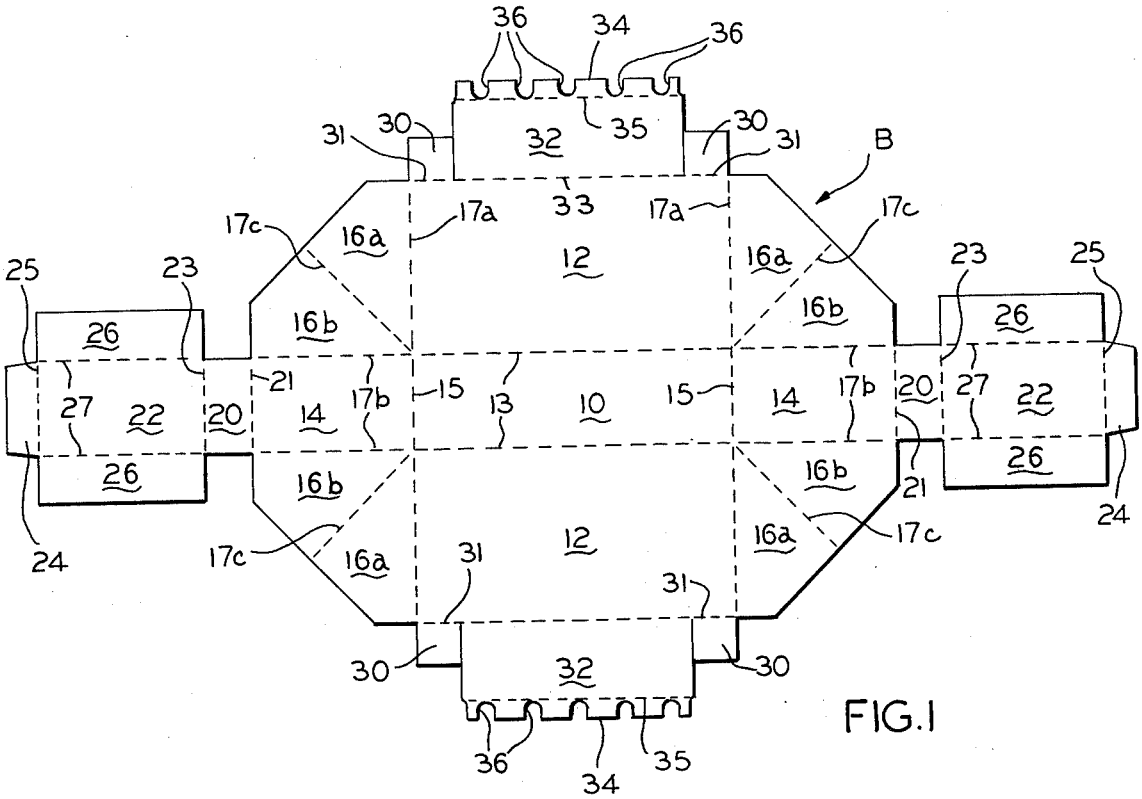
FIG. 1 is a perspective view of an erected but empty carton embodying features of the invention.
Figure 2:
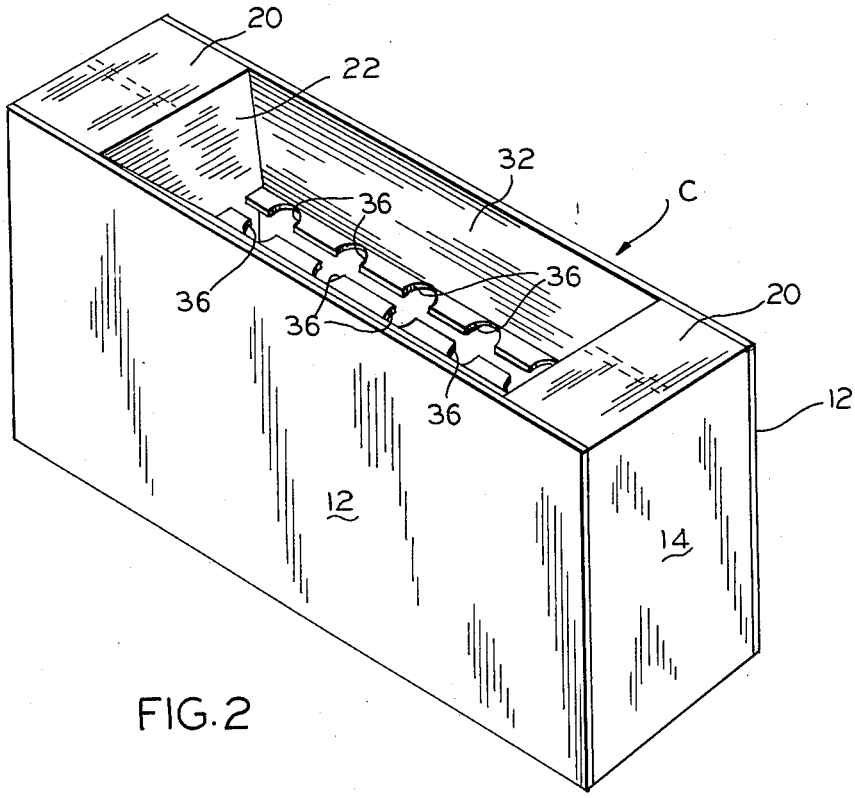
FIG. 2 is a plan view of a blank of foldable sheet material from which the carton illustrated in the other views may be formed.
Figure 3:
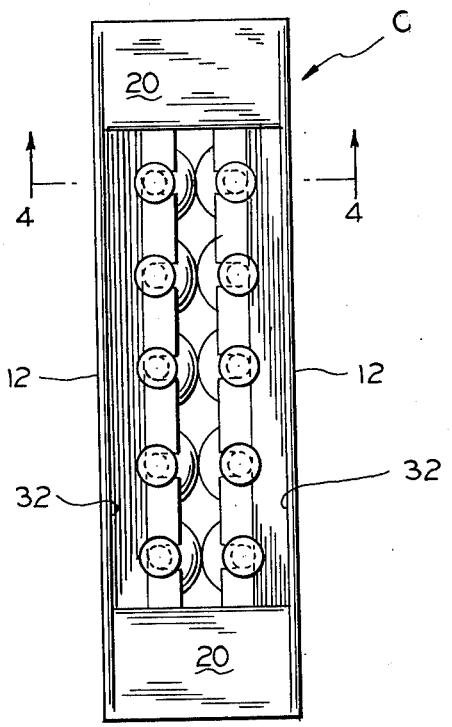
FIG. 3 is a front elevation of a carton filled with packaged articles and shown in a display position resting on one end wall.
Figure 4:
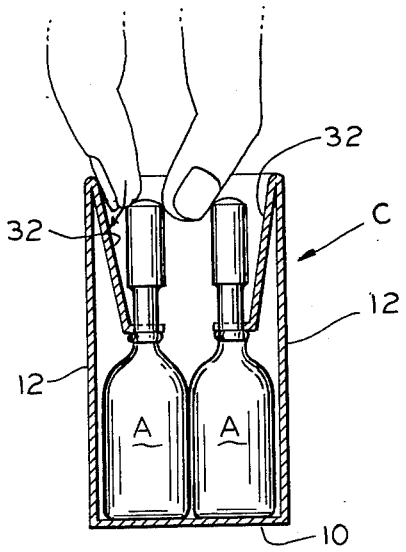
FIG. 4 is a sectional view taken on line 4—4 of FIG. 3.
Figure 6:
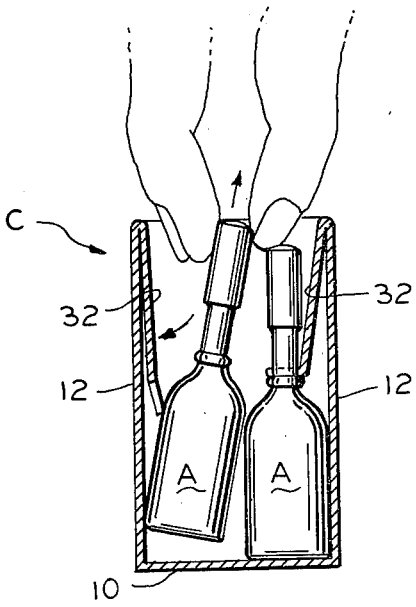

Referring now to the drawings for a better understanding of the invention, it will be seen that the novel dispensing carton, indicated generally at C in FIG. 1, may be formed from a one-piece blank B of foldable sheet material such as paperboard, illustrated in FIG. 2. The carton is designed to hold a plurality of packaged articles A such as small plastic bottles, which may be disposed in a pair of side by side rows, as best seen in FIGS. 3 and 4.

Referring now to FIGS. 1 and 2, it will be seen that carton C includes a bottom wall panel 10 having a pair of opposed outer side wall panels 12, foldably joined at their lower edges on fold lines 13 to opposed side edges of bottom wall panel 10.

The carton also includes a pair of opposed outer end wall panels 14 foldably joined at their lower edges along fold lines 15 to opposed end edges of bottom wall panel 10.

Adjacent edges of related side and end wall panels 12 and 14 are joined to each other at the corners of the carton by bellows or gusset members 16, each of which comprises a pair of generally triangular shaped gusset panels **16*a* and 16*b* which are foldably joined along fold lines 17*a* and 17*b* to related side and end wall panels 12 and 14, respectively, and which are foldably joined to each other along diagonal fold line 17*c* extending outwardly from a corner of the bottom wall panel 10**.

Foldably joined at their outboard edges along fold lines 21 to the upper edges of opposed end wall panels 14 are a pair of top wall panel sections 20 which are folded inwardly toward each other and normal to the end wall panels to provide an interrupted top wall of the carton. A pair of inner end wall panels 22 are foldably joined at their upper edges along fold lines 23 to inboard edges of respective top wall panel sections 20 and are disposed to extend downwardly to bottom wall panel 10. At their lower edges inner end wall panels 22 may be provided with flaps 24 which are foldably joined along fold lines 25 to the lower edges of related panels 22 and which are folded inwardly toward each other normal to panels 22 and in face-to-face relation with the upper surface of bottom wall panel 10. They may be adhesively secured to bottom wall panel 10 if desired. Foldably joined to opposite side edges of each inner end wall panel 22 along fold lines 27 are a pair of side flaps 26 which are folded inwardly toward each other and at right angles to panel 22 so as to lie against the inner surfaces of related outer side wall panels 12. Foldably joined to the upper edges of each of the outer side wall panels 12 at opposite ends thereof along fold lines 31 are pairs of flaps 30 which are folded inwardly at right angles to outer side wall panels 12 and underlying related top wall panel sections 20.

As best seen in FIGS. 3 and 4, inner end wall panels 22 are spaced from each other to define therebetween a well or cavity for receiving the packaged articles A. The articles, which are small plastic bottles, are arranged in pairs of side by side rows. In order to maintain the packaged articles in position there is provided a pair of inner side wall panels or shadow panels 32 which are foldably joined at their upper edges along fold lines 33 to the upper edges of related outer side walls panels 12. A pair of article retaining panels 34 are foldably joined along fold lines 35 to the lower edges of the inner side wall panels 32 and are disposed to extend inwardly toward each other, as illustrated in FIG. 4. Each of the retaining panels 34 are provided with a plurality of slots 37 adapted to receive upper portions of the packaged articles and maintain them in position.

In order to erect the carton the gussets of each gusset member are folded in face to face relation with each other and against the inner surfaces of side walls 12 of the carton at the same time that the end and side walls of the carton are folded upwardly from the bottom wall panel. The panels 26 are folded against the inner surfaces of gusset members and the inner side wall panels are folded downwardly for engagement with the packaged articles.

Figure 5:
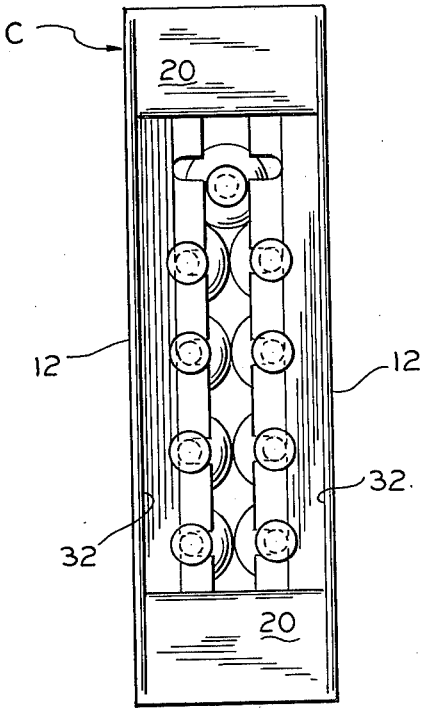
FIGS. 5 and 6 are views similar to FIGS. 3 and 4 but illustrating the manner in which articles are removed from the package.

In order to dispense articles from the carton, when the carton is placed on its end as shown in FIGS. 3 and 5, when a bottle is grasped the fingers force the inner side wall panels apart to permit the bottle to be withdrawn. Each time one bottle from a pair of bottles is removed, the remaining bottle automatically rolls downwardly as shown in FIG. 5.

Thus it will be appreciated that the invention provides a carton for transporting, displaying, and dispensing small articles that is both convenient and attractive.

I claim:

1. A carton, formed of a unitary blank of foldable paperboard or the like, for holding and dispensing, one at a time, a plurality of articles such as small bottles arranged in at least one row extending longitudinally of the carton, said carton comprising:

(a) a bottom wall panel;

(b) opposed pairs of outer end and outer side wall panels foldably joined to and upstanding from opposed end and side edges, respectively, of said bottom wall panel;

(c) a top wall panel including a pair of panel sections foldably joined to the upper edges of respective outer end wall panels and extending inwardly therefrom toward each other but being spaced from each other to provide a central opening in the carton;

(d) a pair of opposed inner end wall panels foldably joined to inboard edges of respective top wall panel sections and extending downwardly therefrom toward said bottom wall panel;

(e) a pair of opposed inner side wall shadow panels foldably joined to upper edges of respective side wall panels, intermediate said top wall panel sections, and extending downwardly into the carton toward each other;

(f) a pair of relatively narrow retaining panels foldably joined to lower edges of respective shadow panels and extending toward each other;

(g) each of said retaining panels having a plurality of longitudinally spaced slots for partial engagement with adjacent packaged articles.

2. A carton according to claim 1, wherein adjacent edges of related outer side and end wall panels are connected to each other by a pair of gussets which are foldably joined to said panels and to each other.

3. A carton according to claim 1, and including pairs of side flaps foldably joined to opposed side edges of each of said inner end wall panels and being folded to lie between the related outer and inner side wall panels.

4. A carton according to claim 1, wherein said inner side wall panels are disposed in downward converging planes.

* * * * *